US007414536B2

(12) United States Patent
Call et al.

(10) Patent No.: US 7,414,536 B2
(45) Date of Patent: Aug. 19, 2008

(54) VALVE MOUNTED BOTTOM OUT SENSOR

(75) Inventors: Evan William Call, Bountiful, UT (US); Kent Walker Mabey, West Jordan, UT (US)

(73) Assignee: ROHO, Inc., Belleville, IL (US)

( * ) Notice: Subject to any disclaimer, the term of this patent is extended or adjusted under 35 U.S.C. 154(b) by 310 days.

(21) Appl. No.: 11/233,793

(22) Filed: Sep. 23, 2005

(65) Prior Publication Data

US 2006/0064820 A1 Mar. 30, 2006

Related U.S. Application Data

(60) Provisional application No. 60/612,663, filed on Sep. 24, 2004.

(51) Int. Cl.
*G08B 21/00* (2006.01)

(52) U.S. Cl. ..... 340/606; 340/589; 340/825.36; 340/815.4

(58) Field of Classification Search ..... 340/606, 340/611, 589, 592, 614, 626, 825.19, 825.25, 340/825.32, 825.36, 815.4; 280/727, 728.1
See application file for complete search history.

(56) References Cited

U.S. PATENT DOCUMENTS 3,741,584 A * 6/1973 Arai ..... 280/735
4,275,869 A * 6/1981 Clements ..... 254/89 H
4,541,136 A * 9/1985 Graebe ..... 5/655.3
5,220,502 A * 6/1993 Qian et al. ..... 600/490
6,108,843 A * 8/2000 Suzuki et al. ..... 5/713
6,772,639 B2 * 8/2004 Seals ..... 73/714
6,848,135 B1 2/2005 Kohlman
6,928,681 B1 * 8/2005 Stacy ..... 5/713
2004/0083550 A1 * 5/2004 Graebe, Jr. ..... 5/654

* cited by examiner

*Primary Examiner*—Daniel Previl
(74) *Attorney, Agent, or Firm*—Polster Lieder Woodruff & Luchessi LP

(57) ABSTRACT

A sensor for attachment to an inflatable air cell cushion to detect a change in immersion depth and bottoming out of the user seated on the cushion. The sensor includes an airflow conduit for attachment to the cushion inflation tube. The airflow conduit comprises a cylindrical body having a longitudinal inner bore. There is an opening through the conduit body in fluid communication with the bore. A transducer is positioned at the opening to detect changes in air pressure within the airflow conduit. The transducer is operatively connected to a warning light, an audible sensor and a mode set button. The functions of the electronic components are preprogrammed into a computer chip. A battery powers the sensor. The recited components are secured within a housing.

9 Claims, 3 Drawing Sheets

VALVE MOUNTED BOTTOM OUT SENSOR

CROSS REFERENCE TO RELATED APPLICATIONS

This application claims the benefit of provisional application Ser. No. 60/612,663, filed Sep. 24, 2004, which is incorporated herein by reference.

STATEMENT REGARDING FEDERALLY SPONSORED

Not applicable

RESEARCH OR DEVELOPMENT

Not applicable

BACKGROUND OF THE INVENTION

The invention relates generally to seating cushions for the prevention of pressure sores and, more particularly, to a sensor for connection to an inflated air cell cushion that detects a loss of air pressure in the air cell cushion resulting in a change in immersion depth of the seated patient and possible "bottoming out" on a relatively hard support surface.

Air cell cushions are known to the art. Generally air cell seat cushions are used by individuals who must remain seated for extended periods of time, for example, a disabled individual who uses a wheelchair for locomotion. Larger air cell cushions, generally configured as mattresses, are used by non-ambulatory or bed ridden individuals. In any event, inflatable air cell cushions are employed to prevent pressure sores on the buttocks. These air cell cushions provide support, while distributing weight, generally uniformly through a multiplicity of interconnected air cells.

The typical air cell cushion includes a base, and an array of interconnected, upstanding individual air cells, usually arranged in transverse and longitudinal rows. An air inflation tube is in fluid communication with one of the cells. The inflation tube includes a screw type valve. The air cell cushion generally has a stretchy cover. A representative embodiment of such an air cell is disclosed in U.S. Pat. No. 4,541,136, which is incorporated herein by reference.

For proper seating on the cushion, the cushion is placed on a relatively firm or hard support surface, such as a wheel chair seat or other type of seat or chair. The user or caregiver opens the valve and pumps air into the cushion until it is well inflated. The user then sits on the cushion and air is released through the valve until the user is optimally immersed in the air cell cushion. The valve then is closed. Generally, proper immersion occurs when the buttocks of the user are immersed about a half-inch to at the most an inch above the bottom. Proper immersion optimizes weight distribution.

In rare instances, the air cell cushion loses air pressure. The user sinks into the cushion, changing his or her immersion depth until he or she "bottoms out". That is, the user's buttocks rest directly on the support surface. Many of the individuals who use these cushions have a loss of feeling in the buttocks. Consequently, the user cannot feel that he or she has bottomed out. If the user remains in a bottomed out position, pressure sores can develop on the buttocks, particularly in the ischial area.

Even absent complete bottoming out, a change in immersion depth can change the optimum force distribution characteristics thereby reducing the effectiveness of the cushion in preventing or treating pressure sores.

It would be advantageous, therefore, to have an apparatus that can detect the loss of air pressure in the cushion, change in immersion depth, and the bottoming out of the user and also emit a warning to alert the user or caregiver.

SUMMARY OF THE INVENTION

One aspect of the invention provides for a sensor for attachment to the inflation valve used for filling the cushion with air, the sensor being designed to detect a change in air pressure in the inflatable cushion and, therefore, immersion depth of a user seated on the cushion by sensing a change in air pressure in the inflation valve. Any type of inflation valve mounted sensor that can detect and indicate a change in the pressure within the inflatable cushion is contemplated by the broader aspects of the invention.

DETAILED DESCRIPTION OF THE INVENTION

The present invention comprises a sensor for attachment to an air cell cushion to sense a drop in air pressure within the air cell cushion resulting from, or causing, a change in user immersion depth. Although one embodiment of the sensor of the present invention is indicated by numeral 1 in FIGS. 1-3, the broader aspects of the invention include any type of sensor that can be mounted to an inflation valve of an inflatable cushion to detect a change in air pressure is considered to be within the scope of the invention.

Figure 1:
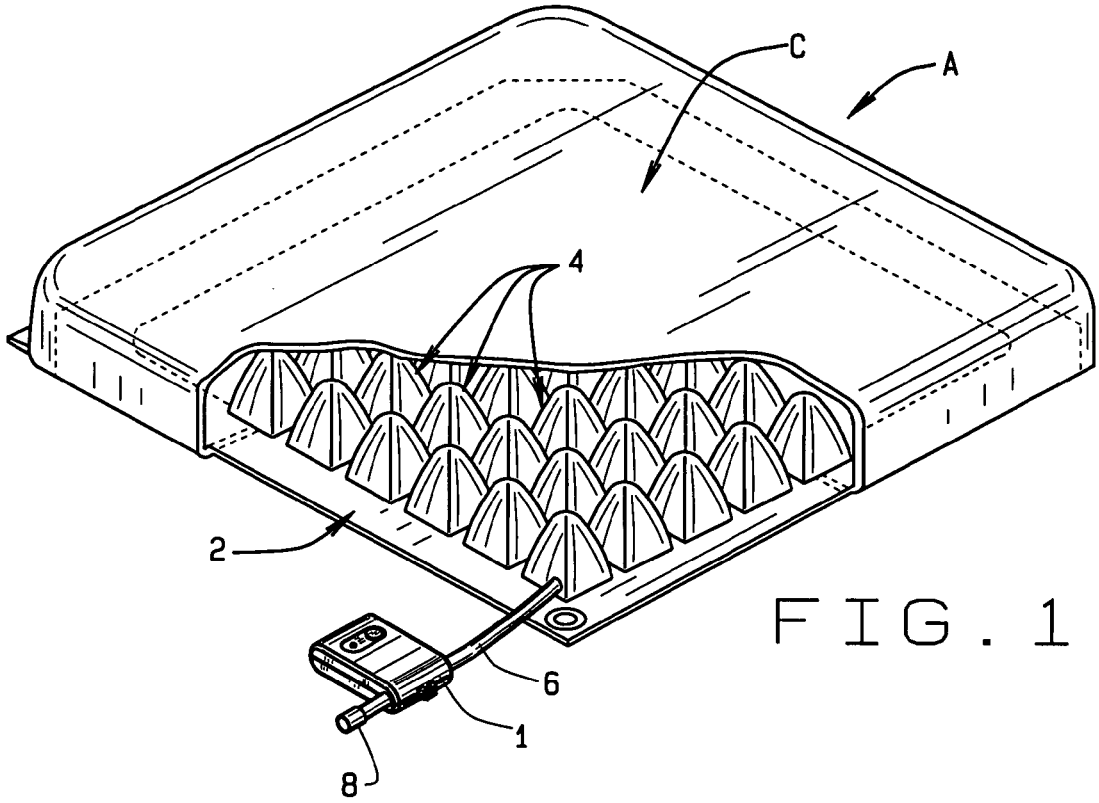
FIG. 1 is a perspective view of an air cell cushion employing the sensor of the present invention.

Sensor 1 is shown attached to an air cell cushion A in FIG. 1. Air cell cushion A, as shown, is representative of the types of air inflation cushions on which sensor 1 can be employed. The typical air cell cushion A includes a base, and an array of interconnected, upstanding individual air cells 4, usually arranged in transverse and longitudinal rows. An air inflation tube 6 is in fluid communication with one of the cells. The inflation tube includes a screw type valve 8. The air cells 4 are in fluid communication through air channels formed in the base so that air introduced into the cushion through inflation tube 6 flows into all the cells until the air pressure is equalized among the cells. The air cell cushion generally has a stretchy cover C. A representative embodiment of such an air cell is disclosed in U.S. Pat. No. 4,541,136, which is incorporated herein by reference. The sensor of the present invention can be used with any type of inflatable cushion, whether employing a plurality of individual air cells or fewer air filled compartments or bladders.

Figure 2:
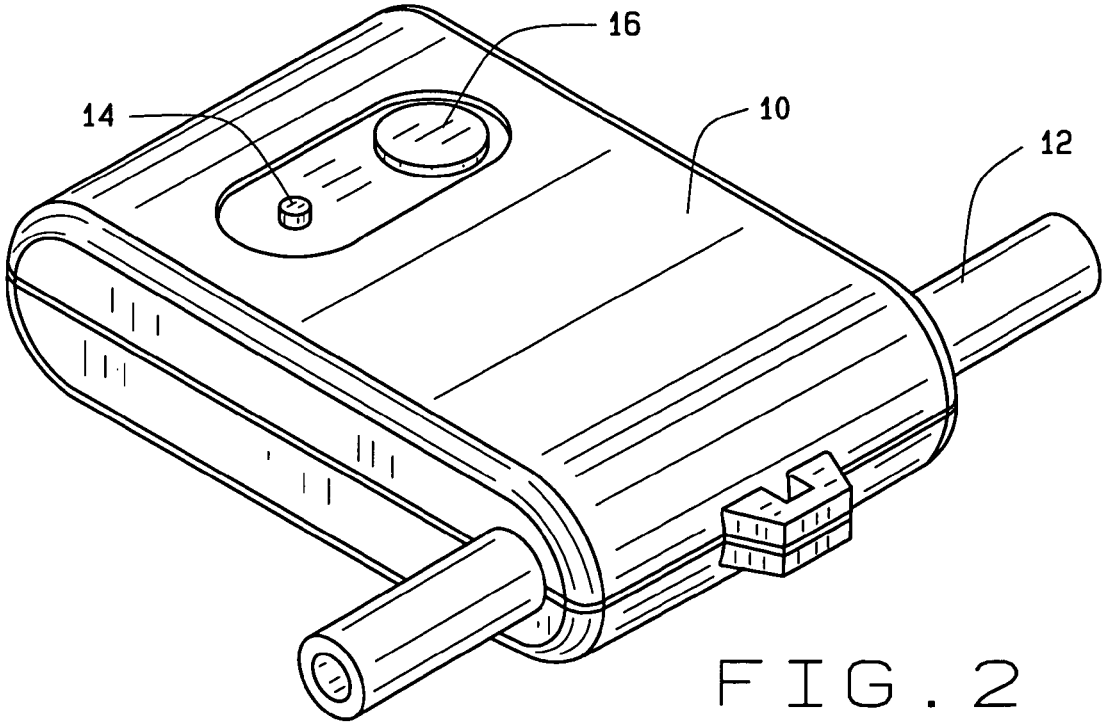
FIG. 2 is a perspective view of one embodiment of the sensor.
Figure 3:
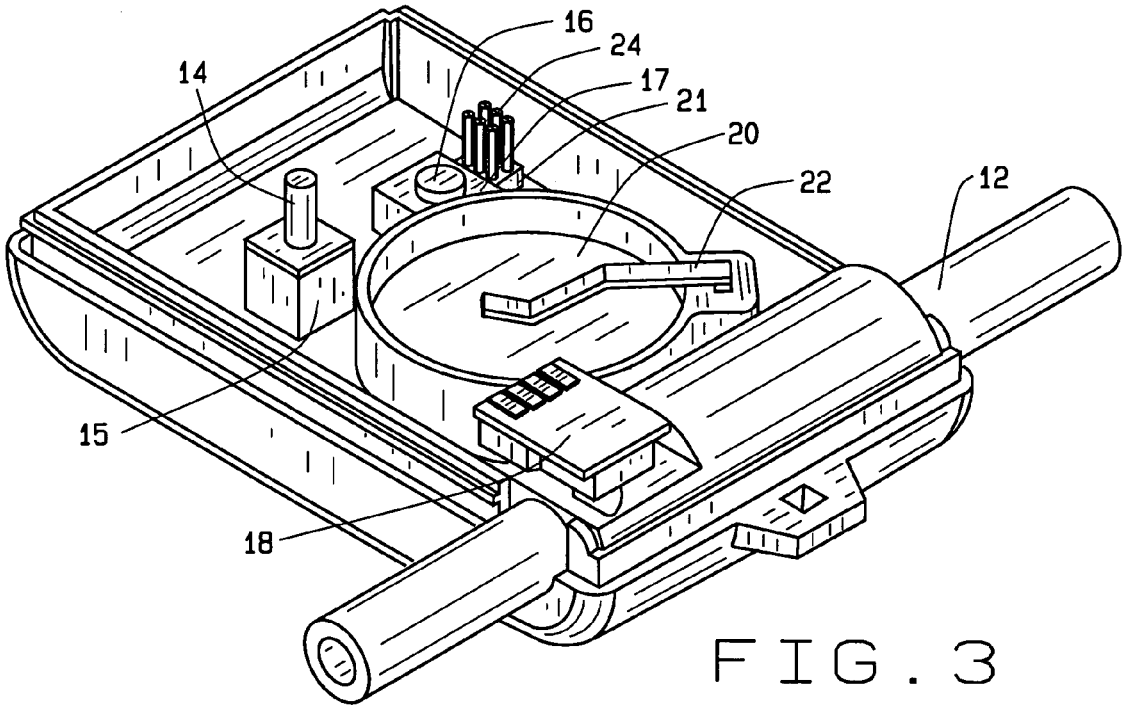
FIG. 3 is a perspective view of the embodiment of the sensor of FIG. 2 with the top of the casing removed to show internal structures.
Figure 4:
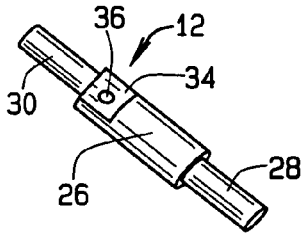
FIG. 4 is a perspective view of the air conduit of the sensor.
Figure 5:
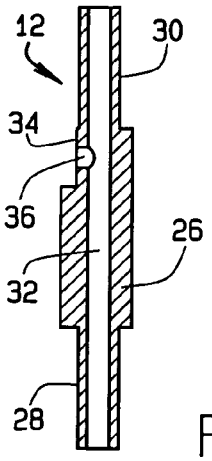
FIG. 5 is a cross sectional view of the air conduit of the sensor.
Figure 6:
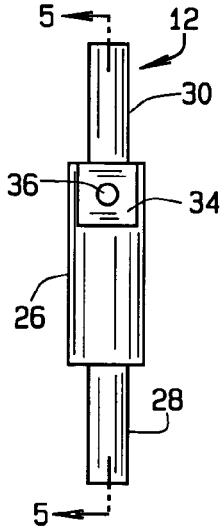
FIG. 6 is a top plan view of the air conduit of the sensor.
Figure 7:
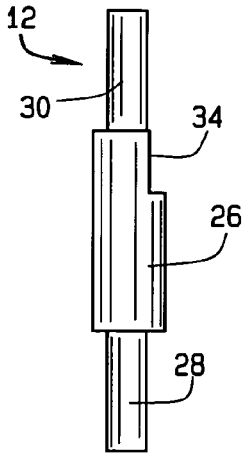
FIG. 7 is a side elevational view of the air conduit of the sensor.

Sensor 1 is shown in greater detail in FIGS. 2 and 3 and includes a housing or casing 10, generally of a clamshell configuration, an airflow conduit 12, an LED indicator 14 and a function set button 16. The internal components of sensor 1, as illustrated in FIG. 3, include the airflow conduit 12, a transducer 18, a battery housing 20 (which houses a disk-shaped battery, not shown, to power the sensor) with connection 22, an LED indicator 14 and base 15, function button 16 and base 17 and plug 24. LED indicator 14 is designed to give a visual indication of the status of the sensor and indicate a loss of pressure. Function set button 16 is used to set the sensor in a set-up, monitoring or check mode, and so forth, as will be explained. There is a programmable computer chip 21 within the housing and operably connected to the elements of the sensor.

Furthermore, sensor 1 includes an audible alarm (not seen) usually mounted inside the top of the case. The audible alarm emits an audible warning signal if there is a change of user immersion depth and internal pressure that is not dependant upon the user visually observing such a change by visualizing the cushion or LED 14. Sensor 1 is set up with a programming connector 24 that facilitates reprogramming the computer chip with firmware.

Airflow conduit 12 is shown in greater detail in FIGS. 4-7. Airflow conduit 12 includes a body section 26, a first concentric tube connector 28 and second concentric tube connector 30 and a longitudinal bore 32 that extends through the entire conduit. Body section 26 is substantially cylindrical, as are the tube connectors 28 and 30. The concentric tube connector sections are dimensioned to fit snugly in the air inflation tube. One section of tube 6 extends between the sensor and the cushion and another section of tube 6 extends between the sensor and screw valve 8.

Although sensor 1 is illustrated as being spliced into air inflation tube 8, the sensor could be mounted in autonomous tubing used only for the sensor or any other appropriate location. Sensor 1 is versatile in that it can be positioned at any location on the cushion. The audible alarm provides for appropriate warning of the user of caregiver, even if the sensor and/or the LEDs are positioned out of sight.

There is a generally flat area 34 at one end of the body section. An opening 36 extending from flat area 34 is in fluid communication with bore 32. As seen in FIG. 3, transducer 18 is positioned on the flat area 34 so that it is in fluid communication with opening 36. In one embodiment of the sensor, transducer 18 includes an internal diaphragm that senses a change in air pressure within bore 32. The transducer converts the change in pressure to an electrical signal that can actuate an LED indicator and/or the audible alarm if the cushion bottoms out.

Sensor 1 functions as follows: screw valve 8 is opened and air is pumped into the cushion through inflation tube 6 (as well as air conduit 12) until all the cells 4 in the array are appropriately inflated. Valve 8 can be closed. However, as can be appreciated, since the inflation tube 6 is in fluid communication with the cushion, the air pressure in tube 6 will be proportional to the air pressure within the cushion. Sensor 1 can emit a warning if the cushion is over inflated, as well. The user positions his or her buttocks on the cushion. The user or caregiver presses button 16 and holds it for about 3 seconds. LED indicator 14 will flash and there is an audible beep or chirp to inform the user that the sensor is set in a detect or monitor mode. Valve 8 is opened and air is released until the user's buttocks are appropriately immersed in the cushion, generally about ½ inch to about 1 inch from the base of the cushion and, consequently, about ½ inch to about 1 inch from the support surface. Valve 8 is then closed.

As will be appreciated, the pressure within inflation tube 6 and airflow conduit 12, which is exerted on pressure transducer 18 through opening 36, generally reflects the pressure within the cushion itself. The user again pushes button 16 to set the reading of the internal pressure at the optimum immersion depth. The LED indicator remains green. The LED indicator will produce an orange light if there is gross over inflation of the cushion.

Sensor 1 is programmed to go into a "sleep" mode to save the battery. However, it is programmed to wake up approximately every minute. If the pressure drops below a predetermined critical point that represents a change in the immersion depth and/or bottoming out or near bottoming out, a continuous audible alarm will sound and LED indicator 14 will show red, indicating that the cushion has bottomed out and patient's buttocks are resting on the support surface, which alleviates pressure within the cushion and thereby actuates the sensor audible alarm and LED indicator warning. Hence, sensor 1 has two warning means, the LED and the audible alarm.

Pressure transducer 18 is excited only for the duration of a check mode, auto zero and calibration, or for a part of a second once a minute during normal monitoring. An operational amplifier with a gain of 550 with some positive offset amplifies the signal up so that a ⅓ battery voltage reference gives numbers that are big enough to manipulate well.

The audible alarm is a piezo electric sounder that is driven differentially to increase its loudness. In a future design it may be necessary to add a small transformer if the alarm is not loud enough in field trials.

The LEDs are driven by a CMOS driver to get enough drive at low voltages.

A single momentary push-button switch is used as the user interface for entering auto zero, entering check mode, for setting the set point and for silencing the alarm. A signal diode is used as a reference for checking the battery level.

There are three thresholds used in the operation of the device. Only one, the optimal pressure, is set by the user and stored off into EEPROM memory, the other two are calculated.

That is: Low Pressure Threshold=Set Point*0.875

High Pressure Threshold=Set Point*1.25

Set Point is the analog to digital conversion of the pressure present at optimal air pressure in the cushion for a specific individual.

Figure 8:
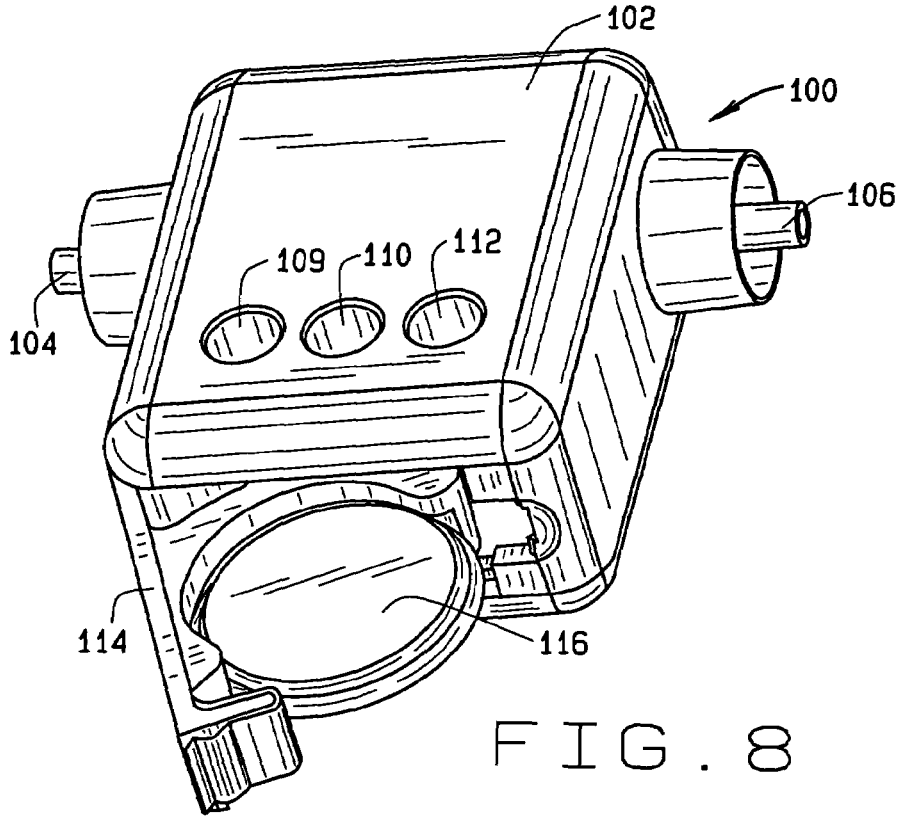
FIG. 8 is a perspective view of another configuration of a sensor of the present invention with the battery compartment opened.
Figure 9:
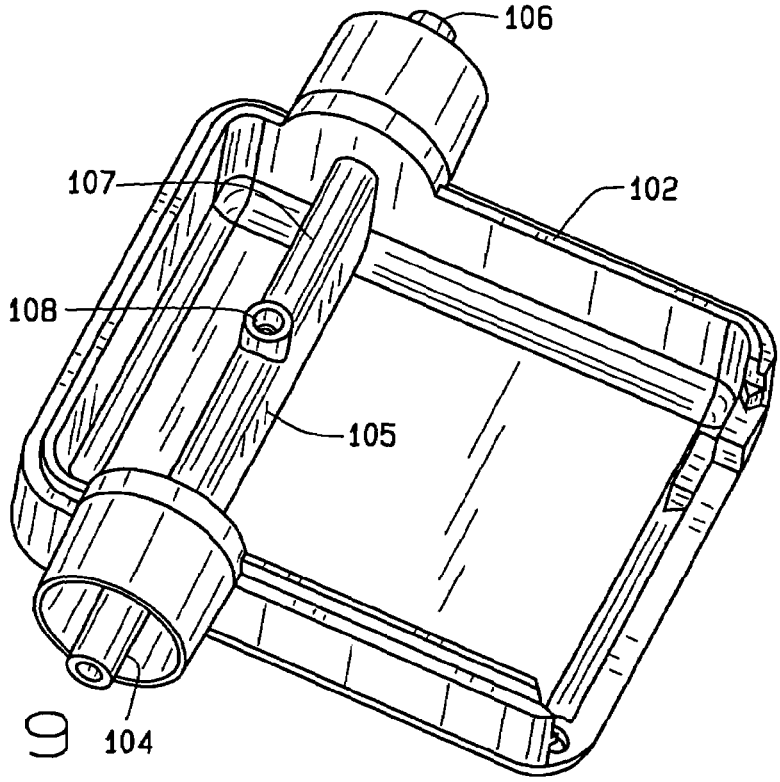
FIG. 9 is a perspective view of one half of the casing of the sensor of FIG. 8.

FIGS. 8 and 9 illustrate another configuration of a sensor of the present invention, indicated generally by numeral 100. Sensor 100 includes all the inner components of sensor 1. It has a casing 102 and connectors 104 and 106 on the casing for attaching the air inflation tubing 8. As seen in FIG. 9, connectors 104 and 106 are operatively associated with the opposite ends of an air conduit 107, which are molded into one half of casing 102. Air conduit 107 has an internal bore (not seen) and an opening 108 that is in fluid communication with the internal bore. A transducer of the type described above is mounted over opening 108, and functions similarly to the transducer previously described.

Sensor 100 does not have an external setting button, but does include three LED indicators, 109, 110 and 112 which indicate green, orange and red, respectively. Sensor 100 basically is actuated when the cushion is inflated and the green LED indicator 109 remains on, the cushion is over inflated, when the orange LED indicator 110 is actuated, or when pressure drops and the red LED indicator 112 is actuated. In the last instance, an audible alarm also sounds.

Sensor 100 includes a slide 114 that includes a battery seat 116. Slide 114 can be opened, as shown in FIG. 9, to provide access to the battery.

It will be appreciated from the foregoing discussion that sensor 1 is not used to determine a specific or quantifiable internal pressure within the cushion, which is significant because the quantifiable internal pressure for proper immersion of different users may vary between users, depending upon the user's body weight, the user's desired or optimum immersion depth, and the firmness of the support surface, for example. Hence, it is advantageous to have a sensor that can determine change in immersion depth, and bottoming out, based upon a relative change in internal pressure after an initial internal pressure is set in the sensor upon proper user immersion.

Also, since change in immersion depth and potential bottoming out is determined based upon a relative change in internal pressure, there is no need for the user or the caregiver to visually monitor an internal air pressure reading by visually monitoring a gauge, be it analog or digital. Consequently, even if sensor 1 is positioned out of the user or caregiver's sight, the audible alarm will provide a warning of a change in immersion depth.

It will be appreciated that any configuration of sensor that functions to detect and indicate a change in immersion depth, internal pressure or bottoming out condition is intended to be encompassed by the scope of the invention. For example, the sensor could be powered by solar energy rather than a battery or could include a rechargeable power supply or could have other types of warning indicators, such as pop-ups that can be checked tactilely, and so forth.

The invention claimed is:

1. In an inflatable cushion having an inflation tube for filling the cushion with air, a sensor having an air conduit within the inflation tube, said sensor including a transducer operatively associated with the air conduit disposed to detect a change in air pressure in the inflatable cushion through a change in a pressure in the inflation tube caused by a change in an immersion depth of a user seated on the cushion which causes the change in air pressure in the inflation tube.

2. A sensor for attachment to the inflation tube of an inflatable cushion to detect a change in immersion depth of a user seated on the cushion comprising an air flow conduit configured for mounting in fluid communication within the cushion inflation tube, a transducer operatively associated with the air flow conduit, and a signaling apparatus operatively associated with the transducer wherein a change in an air pressure in the inflation tube resulting from the change in immersion depth of the user is detected by the transducer which actuates the signaling apparatus.

3. The sensor of claim 2 wherein said signaling apparatus further comprises a visual indicator.

4. The sensor of claim 3 wherein the visual indicator further comprises an LED.

5. The sensor of claim 2 wherein said signaling apparatus further comprises an audible alarm.

6. The sensor of claim 2 further comprising a mode set button operatively connected to the transducer.

7. The sensor of claim 2 further comprising an appropriately programmed computer chip for controlling functions of the sensor.

8. A sensor for attachment to the inflation tube of an inflatable air cell cushion to sense a change of pressure in the immersion depth of a user seated on the cushion comprising:

an airflow conduit for attachment to the cushion inflation tube, the airflow conduit including a cylindrical body configured for incorporation into the inflation tube, the cylindrical body having a longitudinal inner bore and an opening through the conduit body in fluid communication with the bore;

a transducer positioned at the air conduit opening to detect a change in air pressure within the airflow conduit;

at least one indicator light operatively connected to the transducer;

an audible alarm operatively connected to the transducer;

a mode set button operatively connected to the transducer, the at least one indicator light and the audible alarm;

a programmable computer chip for controlling the functions of the sensor; and a housing for enclosing the recited elements.

9. An inflatable cushion comprising:

an inflatable cushion body;

an inflation tube for inflating the inflatable cushion body having a first end in fluid communication with the inflatable cushion body and a second end having an inflation valve thereon;

a sensor attached to the inflation tube between the first end of the inflation tube and the inflation valve to sense a change of pressure in the inflation tube caused by a change in an immersion depth of a user seated on the cushion, the sensor including an airflow conduit for incorporation into the inflation tube, the airflow conduit including a cylindrical body having a longitudinal inner bore and an opening through the conduit body in fluid communication with the bore; a transducer positioned at the air conduit opening to detect a change in air pressure within the airflow conduit; at least one indicator light operatively connected to the transducer; an audible alarm operatively connected to the transducer; a mode set button operatively connected to the transducer, the at least one indicator light and the audible alarm; and a programmable computer chip for controlling the functions of the sensor.

* * * * *